US011761204B2

(12) United States Patent
Dajnko

(10) Patent No.: US 11,761,204 B2
(45) Date of Patent: Sep. 19, 2023

(54) INSULATED CONCRETE FORM CONSTRUCTION METHOD AND SYSTEM

(71) Applicant: INTEGRATED CONCRETE FORMING LTD., Sharon (CA)

(72) Inventor: Marjan Dajnko, Sharon (CA)

(73) Assignee: INTEGRATED CONCRETE FORMING LTD., Sharon (CA)

( * ) Notice: Subject to any disclaimer, the term of this patent is extended or adjusted under 35 U.S.C. 154(b) by 0 days.

(21) Appl. No.: 17/524,453

(22) Filed: Nov. 11, 2021

(65) Prior Publication Data

US 2022/0064946 A1 Mar. 3, 2022

Related U.S. Application Data

(63) Continuation of application No. 15/568,276, filed as application No. PCT/CA2016/050125 on Feb. 11, 2016, now Pat. No. 11,203,866.

(60) Provisional application No. 62/150,077, filed on Apr. 20, 2015.

(51) Int. Cl.
*E04B 2/86* (2006.01)
*E02D 27/02* (2006.01)

(52) U.S. Cl.
CPC ..... *E04B 2/8635* (2013.01); *E04B 2/8641* (2013.01); *E04B 2/8652* (2013.01); *E02D 27/02* (2013.01); *E04B 2002/867* (2013.01)

(58) Field of Classification Search
None
See application file for complete search history.

(56) References Cited

U.S. PATENT DOCUMENTS 3,552,076 A * 1/1971 Gregori ..... E04B 2/8611 52/438
4,669,234 A * 6/1987 Wilnau ..... E04B 2/8647 52/426
4,884,382 A * 12/1989 Horobin ..... E04B 2/8641 52/564
5,038,541 A * 8/1991 Gibbar, Jr. ..... E04B 2/8652 52/426
5,040,344 A * 8/1991 Durand ..... E04B 2/8652 52/127.2
5,107,648 A * 4/1992 Roby ..... E04B 2/8647 52/564
5,570,552 A * 11/1996 Nehring ..... E04B 2/8641 52/564

(Continued)

OTHER PUBLICATIONS

International Search Report dated Apr. 19, 2016 from WO 2016/168916 A1, 5 pgs.
Examiner's Report dated Jan. 12, 2023 from CA2983463, 5 pgs.

*Primary Examiner* — Joshua K Ihezie
(74) *Attorney, Agent, or Firm* — Jenna L. Wilson; Wilson Lue LLP

(57) ABSTRACT

A system and method for constructing an insulated concrete form (ICF) wall are provided. Vertically-oriented pairs of ICF foam panels of an ICF structure are erected above a footing, with vertical panel supports located along opposed vertical edges of each set of adjacent vertically-oriented panel pairs. An internal brace support, extending longitudinally along the structure, is installed between the individual panels of the panel pairs. Concrete is poured between the erected vertically-oriented ICF foam panels to complete the ICF wall.

17 Claims, 11 Drawing Sheets

(56) References Cited

U.S. PATENT DOCUMENTS 5,701,710 A * 12/1997 Tremelling ..... E04B 2/8635 52/592.1
5,809,726 A 9/1998 Spude
5,809,727 A 9/1998 Mensen
5,860,262 A * 1/1999 Johnson ..... E04B 1/14 52/294
5,887,401 A * 3/1999 Moore, Jr. ..... E04B 2/8635 52/439
5,992,114 A * 11/1999 Zelinsky ..... E04B 2/8652 249/34
6,250,033 B1 * 6/2001 Zelinsky ..... E04B 2/8652 52/275
6,378,261 B1 * 4/2002 Agsten ..... E04B 2/8635 52/425
6,474,033 B1 * 11/2002 Luchini ..... E04B 2/8652 249/40
6,609,340 B2 * 8/2003 Moore, Jr. ..... E04B 2/8641 52/562
6,622,452 B2 * 9/2003 Alvaro ..... E02D 27/02 52/294
6,698,710 B1 * 3/2004 VanderWerf ..... E04B 2/8652 52/294
7,032,357 B2 4/2006 Cooper et al.
7,124,547 B2 * 10/2006 Bravinski ..... E04C 5/168 52/564
7,762,033 B2 * 7/2010 Scott ..... E04B 2/06 52/432
7,882,672 B2 * 2/2011 Emblin ..... E04B 1/161 52/562
7,963,080 B1 6/2011 Bowman
8,122,653 B2 2/2012 Ellebracht et al.
8,887,465 B2 * 11/2014 Crosby ..... E04B 2/8635 52/745.1
9,359,778 B1 * 6/2016 Kreizinger ..... E04B 2/86
2001/0029717 A1 * 10/2001 Spakousky ..... E04B 2/8617 52/745.1
2004/0231263 A1 * 11/2004 McKay ..... E04B 2/8652 52/426
2006/0151677 A1 * 7/2006 McIvor ..... E04B 2/8617 249/40
2009/0013629 A1 * 1/2009 Boeshart ..... E04B 2/8617 52/309.4
2009/0107074 A1 * 4/2009 Boeshart ..... E04B 2/8617 52/655.1
2009/0151281 A1 * 6/2009 MacDonald ..... E04B 2/8641 52/794.1
2010/0005736 A1 1/2010 Dayton et al.
2012/0186180 A1 * 7/2012 LeBlang ..... E04B 2/763 52/698
2013/0036688 A1 * 2/2013 Gosain ..... E04B 2/8647 52/220.1
2013/0180192 A1 * 7/2013 Crosby ..... E04B 2/8635 52/426
2013/0312350 A1 * 11/2013 Kreizinger ..... E04G 11/00 52/426
2013/0318898 A1 * 12/2013 Way ..... E04B 2/8635 52/425
2014/0000199 A1 1/2014 Black
2014/0157704 A1 * 6/2014 McDonagh ..... E04G 21/185 52/426
2015/0089894 A1 * 4/2015 Ryan ..... E04B 2/8641 52/426
2015/0159339 A1 * 6/2015 Castonguay ..... E04B 2/8635 52/426
2015/0167295 A1 * 6/2015 Baader ..... E04B 2/8635 249/40
2017/0218614 A1 * 8/2017 Ciuperca ..... C04B 40/04

* cited by examiner

INSULATED CONCRETE FORM CONSTRUCTION METHOD AND SYSTEM

CROSS-REFERENCE TO RELATED APPLICATIONS

This application is a continuation of U.S. patent application Ser. No. 15/568,276 filed Oct. 20, 2017, which is a national phase of International Application No. PCT/CA2016/050125 filed Feb. 11, 2016, which claims priority to U.S. Provisional Application No. 62/150,077 filed Apr. 20, 2015, the entireties of which are incorporated herein by reference.

TECHNICAL FIELD

This disclosure relates to insulated concrete form construction of building structures, and associated methods and systems.

TECHNICAL BACKGROUND

Basement foundations are typically constructed out of concrete block or poured concrete using standard wood forms. In recent years there has been a rise of insulated concrete form (ICF) construction; however, it has had limited application in foundations.

ICF has been proposed for foundation construction as it provides a foundation wall with a high thermal resistance, since the concrete core of the wall is encased by opposed insulated forms. An ICF foundation wall is inherently mold resistant because the dewpoint will typically be located in the middle of the concrete core of the ICF wall, providing no condensation surface to attract and trap moisture.

Despite the inherent advantages in the use of ICF for foundation walls, applying ICF to foundation construction has proven to be difficult as to date it has been more labour intensive to complete a foundation using ICF techniques that have been developed for above ground applications. For example, standard ICF techniques require temporary external bracing to be erected prior to the concrete pour. Unlike standard wood forms used for conventional poured concrete foundations, the temporary external bracing consists of a number of steel or wood elements that must be assembled on-site to support the vertical seams between the ICF foam form panels in order to provide the necessary support to the foam forms during the concrete pour. The temporary external bracing remains in place during the concrete pour, and then must be disassembled once the concrete has sufficiently cured.

Builders have found this process to be laborious and considerably slower to complete than existing techniques employing concrete blocks or poured concrete with standard wood forms. Moreover, builders with multiple ICF projects must ensure they have sufficient external bracing available for their projects, as external bracing is required not only during the concrete pour, but also during the concrete curing period; furthermore, time is required to disassemble the external bracing at a given site in order to make it available for the next project. Thus, ICF foundations have not been popular as a construction technique for large planned community developments, where it is preferable to pour multiple foundations within a single day.

BRIEF DESCRIPTION OF THE DRAWINGS

In drawings which illustrate by way of example only embodiments of the present disclosure.

DETAILED DESCRIPTION

The methods and systems described herein accordingly provide for improvements in ICF construction, and in particular improvements in the construction of building foundations using ICF techniques. However, while the examples below are directed in particular to foundation wall construction, it will be appreciated by those skilled in the art that these examples can have wider applicability within insulated concrete form construction.

In an implementation a method is provided for constructing an insulated concrete form (ICF) wall. The method may comprise erecting a first vertically-oriented ICF foam panel pair above a footing; locating a vertical panel support along opposed vertical edges of one side of the first vertically-oriented ICF foam panel pair, and engaging the vertical panel support to the opposed vertical edges; erecting a second vertically-oriented ICF foam panel pair above the footing adjacent to the first vertically-oriented ICF foam panel pair, and engaging corresponding second vertical edges of the second vertically-oriented ICF foam panel pair with the vertical panel support; repeatedly locating corresponding next vertical panel supports and next vertically-oriented ICF foam panel pairs adjacent to previously erected vertically-oriented ICF foam panel pairs; installing an internal brace support between the erected vertically-oriented ICF foam panel pairs; and, pouring concrete between said erected vertically-oriented ICF foam panels to complete said ICF wall.

In an implementation a system for an insulated concrete form (ICF) wall is provided. The system may comprise a plurality of vertically-oriented ICF foam panel pairs, and a plurality of vertical panel supports. The plurality of vertical panel supports each adapted to engage with the opposed vertical edges of adjacent vertically-oriented ICF foam panel pairs. An internal brace support, located within the void of the vertically-oriented ICF foam panel pairs extends along the length of the wall. In an aspect, horizontally-oriented base ICF foam panel pairs may be situated directly on the footing, and the vertically-oriented ICF foam panel pairs may be erected on top of the horizontally-oriented base ICF foam panel pairs. In an aspect, one or more superior, horizontally-oriented ICF foam panel pairs may be situated above the vertically-oriented ICF foam panel pairs. The system may be completed into the insulated concrete form (ICF) wall by pouring concrete into the void between the vertically-oriented ICF foam panel pairs, and horizontally-oriented ICF foam panel pairs.

Figure 1:
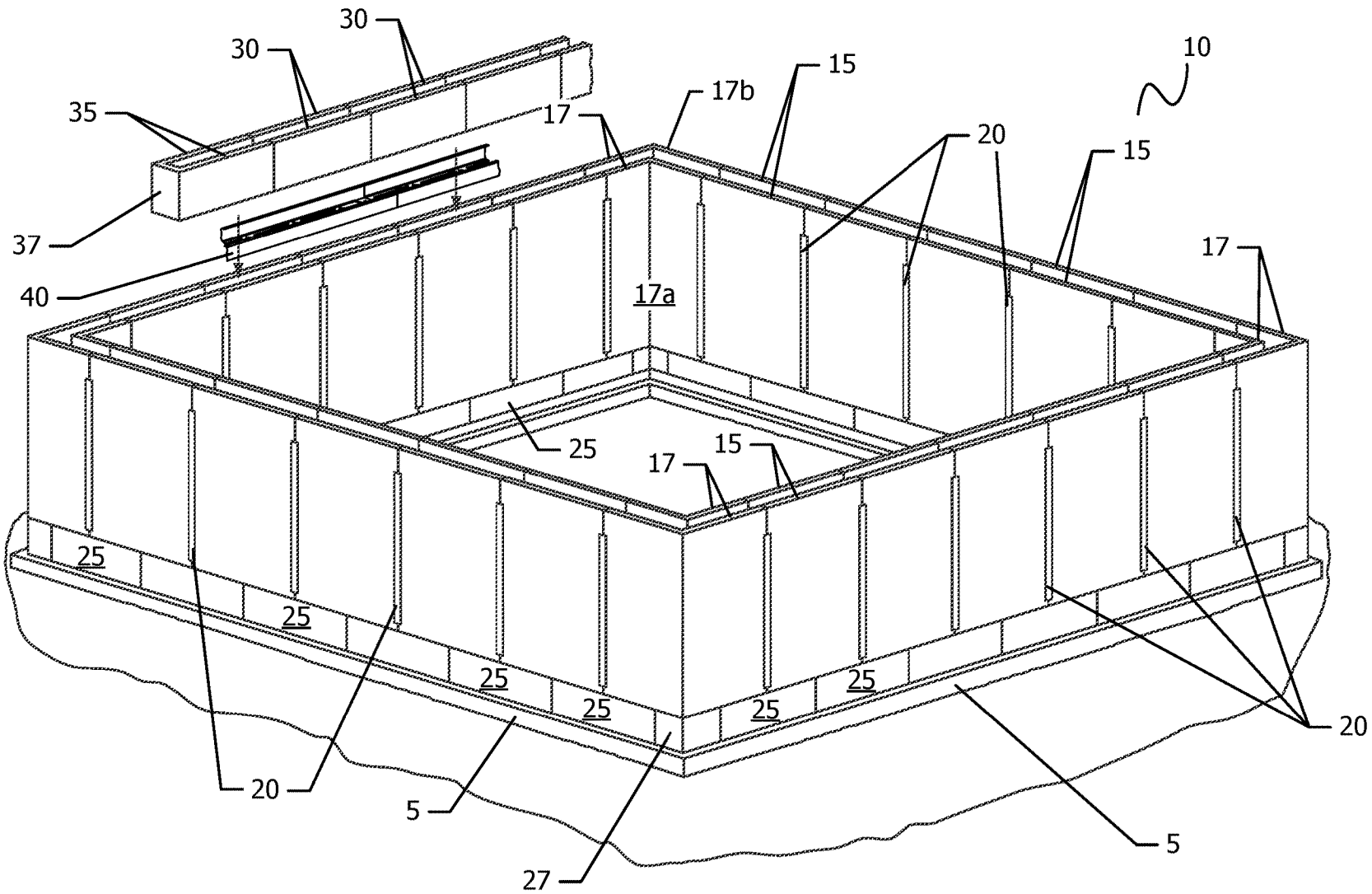
FIG. 1 is a perspective view of an example assembly for use in ICF foundation construction.

FIG. 1 illustrates a perspective exploded view of an example ICF foundation wall system 10 for construction of a relatively simple foundation wall. The foundation wall system 10 in this example comprises a plurality of vertically-oriented ICF foam panels 15, arranged in pairs, mounted on supporting or base pairs of horizontally-oriented ICF foam panels 25, which in turn are assembled on a footing 5.

In this example, the foundation wall is designed with substantially right-angled corners; accordingly, pairs of right-angled vertically-oriented ICF foam panels 17 may be used between adjacent pairs of substantially flat foam panels 15 at corners of the ICF foundation wall system 10. Similarly, pairs of angled horizontally-oriented base panels 27 may be provided between adjacent pairs of substantially flat foam panels 27. It will be understood by those skilled in the art that these ICF foam panels 15, 17, 25, 27 may be provided with any suitable contour or angle to accommodate the specific design of the building layout for which the foundation is intended. For instance, foam panel pairs may comprise curved surfaces, or have corners with angles other than 90 degrees.

Furthermore, it will be readily understood by those skilled in the art that "vertically-oriented" and "horizontally-oriented" refer to the general orientation of a major axis or dimension of a panel; thus, in the case of a vertically-oriented panel, the larger dimension (e.g., the length) of the panel is oriented substantially vertically with respect to the footing 5, whereas the larger dimension of a horizontally-oriented panel is oriented substantially perpendicularly to the footing 5.

It will further be understood that generally, the dimensions (i.e., the length and width) of each panel of a pair of substantially flat foam panels 15 or 25 that define a flat portion of the foundation wall or other structure will be substantially equal. However, where the foundation wall or other structure has a shaped contour, such as a curvature or angle, the dimensions of the foam panels used to define that contour may not be equal in dimension. For instance, to define a corner in the system 10 shown in FIG. 1, a corresponding pair of shaped foam panels 17 or 27 is used. The foam panel used to define the interior corner (for example, panel 17*a* shown in FIG. 1) is smaller than the foam panel 17*b* used for the exterior corner. The sizes of the panels 17*a*, 17*b*, as well as any other panels used in the ICF systems contemplated herein, may be manufactured to the required dimensions, or cut down from a larger size, as necessary. Additionally, it will be appreciated that while the accompanying illustrations generally depict a foundation wall of substantially consistent thickness, in some implementations it may be desirable to provide a foundation wall or other type of ICF wall with varying thickness, and the shape or relative positions of the ICF foam panels can be adjusted accordingly.

Generally, several pairs of ICF foam panels are mounted adjacent to each other within the foundation wall system 10 to provide a substantially contiguous wall defining the inner and outer boundaries of the foundation wall. The space between the corresponding pairs of panels defines a region for receiving poured concrete. To maintain the relative positions of, and support, the ICF foam panels 15, 17 and to reduce separation or "bowing out" of the panels 15, 17 during the concrete pouring process, vertical panel supports 20 are provided along the seams between adjacent ICF foam panels 15, 17. One or more internal brace supports 40 also extend along and between the pairs of ICF foam panels 15, 17.

The height of the foundation wall system 10 from the footing 5 is determined by the total height of the corresponding pairs of ICF foam panels 15, 25 and/or 17, 27. To accommodate changes in elevation around the foundation wall system 10, as well as building features such as doors and windows, it may be desirable to be able to vary the height of the foundation walls defined by the foundation wall system 10. For example, pairs of superior horizontally-oriented ICF foam panels 30 may be stacked onto the vertically-oriented ICF foam panel pairs 15 to bring the height of the ICF foundation wall system 10 to a desired additional height at a given location. The additional height may not be required at all locations along the foundation wall; accordingly, steps or changes in the total height may be defined by providing one or more pairs of foam panels 35 with a terminating end wall 37. In the example of FIG. 1, the terminating end wall 37 marks a change in height from the top of the pairs of vertically-oriented ICF foam panels 15, stepping up to a height defined by the pairs of superior horizontally-oriented ICF foam panel 30, 35. Depending upon requirements, additional pairs of superior horizontally-oriented ICF foam panels 30 may be stacked up at desired locations of the ICF foundation wall system 10 to increase the total height from the footings 5.

The various pairs of ICF foam panels 15, 17, 25, 27, 30, 35 can be provided with upper and lower mating surfaces (not shown in FIG. 1) that engage a corresponding lower or upper mating surface, as the case may be, of a vertically adjacent foam panel. The mating surface may be provided, for example, by an interlocking texture, a series of crenellations, or cooperating projections and recesses. An example of projections or crenellations on an upper face of a foam panel 15*b* is shown in FIG. 1. These projections can mate with corresponding recesses provided on a lower face of another foam panel.

Figure 2:
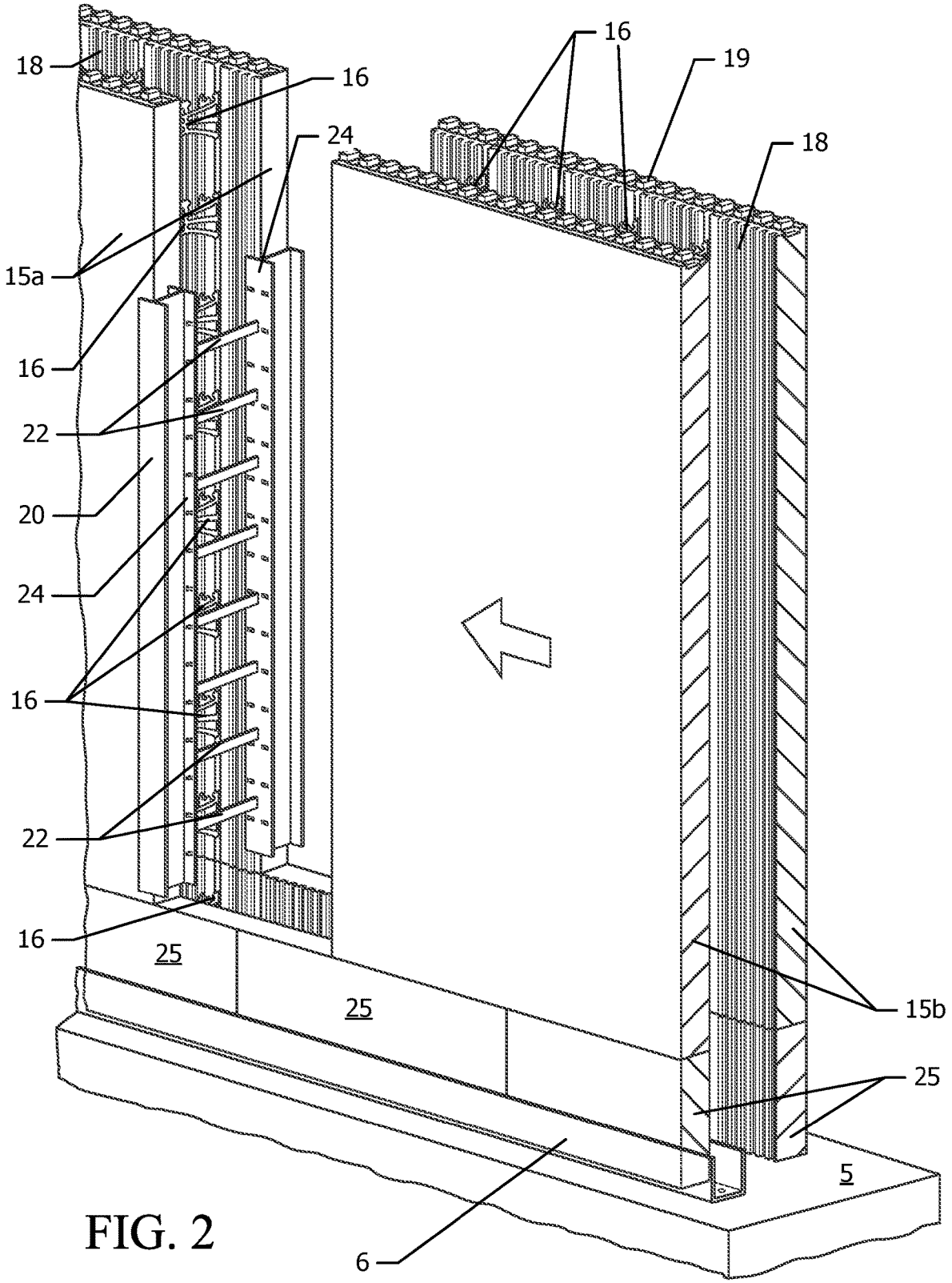
FIG. 2 is a perspective view of the assembly of adjacent pairs of ICF panels within the example assembly of FIG. 1.

FIG. 2 illustrates the assembly of pairs of ICF foam panels 15. Initially, to support the lowest level of foam panels in the system 10 (in this case, the horizontally-oriented ICF foam panels 25, 27), a channel 6 is mounted on the footing for receiving the foam panels to support the ICF foundation wall both prior to and during the concrete pour. FIG. 2 illustrates the use of a C-channel, which is fastened to the footing 5. Only a single channel 6 to retain one foam panel of a pair of foam panels need be provided, although pairs of channels 6 may also be used.

The pairs of horizontally-oriented foam panels 25 are then positioned on the footing, and then a first pair of vertically-oriented foam panels 15*a* is mounted on top of the pairs of horizontally-oriented foam panels 25. To retain both the horizontally-oriented and vertically-oriented foam panels in fixed relation to one another, form ties 16 are mounted to interior faces of the foam panels as can be seen between 25 and 15*a* in FIG. 2. A variety of form ties 16 in different sizes and configurations will be known to those in the art. Optionally, rebar or other reinforcement means other than the internal brace support 40 can be inserted between the pairs of foam panels and supported by form ties 16.

A vertical panel support 20 is provided between adjacent pairs of vertically-oriented foam panels 15*a*, 15*a* and 15*b*, 15*b*. Each vertical panel support 20 comprises a pair of clip members 24 coupled by support tie members 22. Each clip member 24 is configured to engage with opposed vertical edges of adjacent foam panels and also with an interior face of the foam panels. In the example of FIG. 2, the clip members 24 are substantially I-beam shaped, with each channel of the beam sized to receive a vertical edge of the foam panel 15*a*, 15*b*, and an end wall of each beam configured to engage the interior foam panel face 18, as will be discussed in more detail with reference to FIGS. 14-17.

A next pair of vertically-oriented ICF foam panels 15*b* is then mounted adjacent to the first pair of vertically-oriented ICF foam panels 15*a*. Vertical edges and interior faces of the foam panels 15*b* are engaged with the clip members 24. The arrow in FIG. 2 illustrates the direction of installation of the pair of foam panels 15*b*, which are slid along (or substantially parallel to) the channel 6 towards the first pair of foam panels 15*a*. Once the next pair of foam panels 15*b* has been engaged with the clip members 24, a further vertical panel support 20 can be mounted on the pair of foam panels 15*b*, and the process repeated around the perimeter of the foundation wall.

Figure 3:
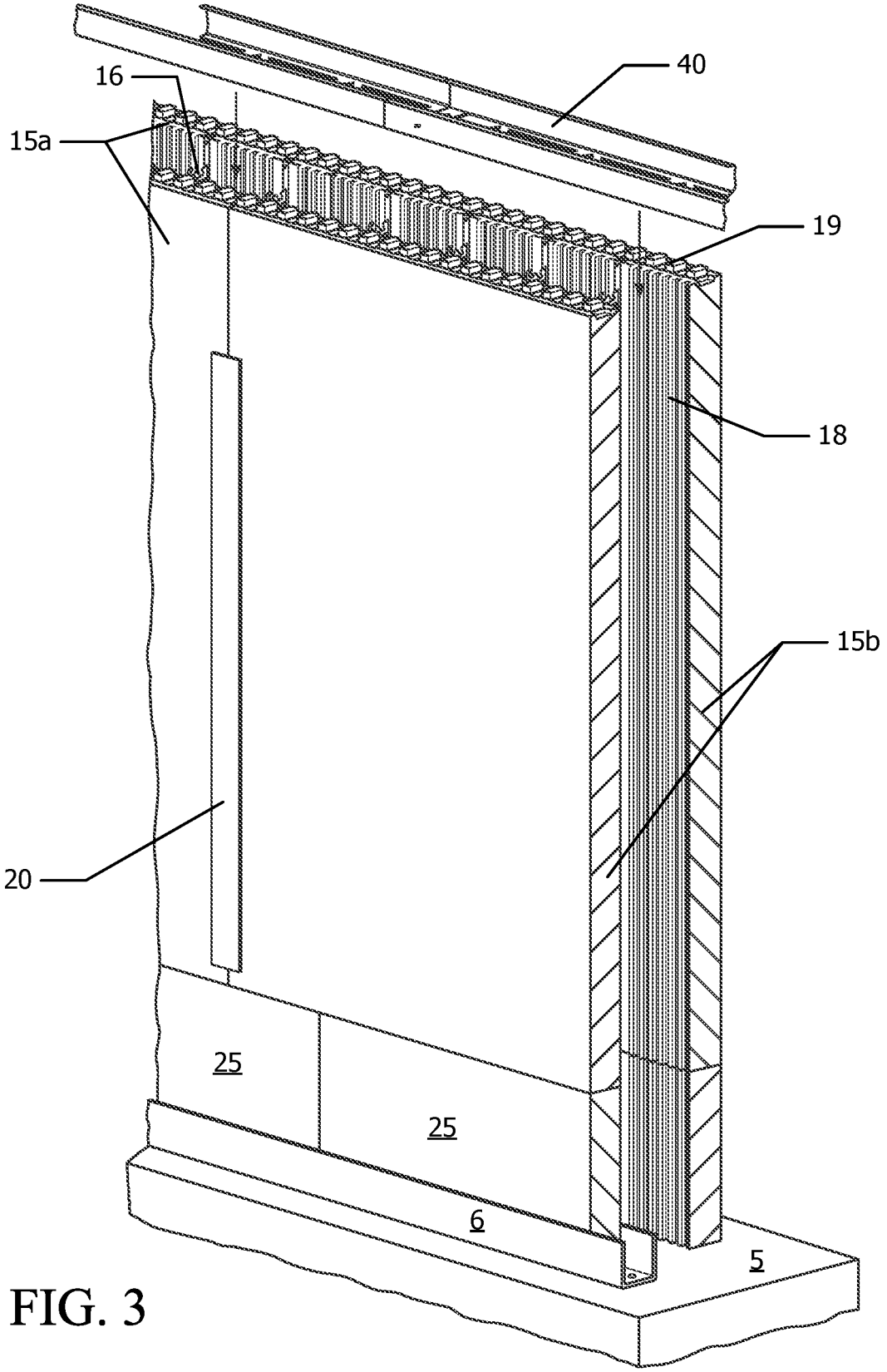
FIG. 3 is a perspective view of the insertion of an internal brace support between the adjacent pairs of ICF panels of FIG. 2.

Like the form ties 16, the vertical panel support 20 assists in maintaining spacing between the pairs of vertically-oriented foam panels 15*a*, 15*b*. The vertical panel support 20 also couples adjacent foam panels 15*a*, 15*b* and provides rigidity along the seam between these panels. FIG. 3 illustrates the same section of the system 10 as FIG. 2, once the second pair of vertically-oriented foam panels 15*b* has been erected.

An internal brace support 40 is then mounted between the erected pairs of foam panels 15*a*, 15*b*. Depending upon the implementation, the internal brace support 40 may be positioned on top of a top row of form ties 16. The internal brace support 40 extends laterally along the length of the wall to provide support during the concrete pour, and can provide further reinforcement to the wall after the concrete cures. Depending on the dimensions of the foundation wall to be poured, the vertical panel supports 20 and internal brace support 40 may provide an ICF structure that is able to receive a concrete pour with no, or minimal, external bracing. For example, longer wall lengths may require some external bracing proximate to the center of the wall during the concrete pour, while shorter wall lengths may not require any external bracing at all.

The internal brace support 40 may be provided in units corresponding to a total length of foundation wall, or alternatively may be provided in one or more fixed length sections that may be fastened together to provide a continuous internal brace support 40 extending the length of a foundation wall section. The internal brace support 40 comprises an elongated member sized to fit between the pairs of ICF panels along a length of ICF assembly wall, shaped to permit passage of poured concrete (e.g., through punchouts or other recesses provided through or along the body of the elongated member), while supporting the ICF assembly. The internal brace support 40 can include sides projecting form the body of the member, which contact the interior faces of the ICF panels to provide support to the ICF panels.

Figure 4:
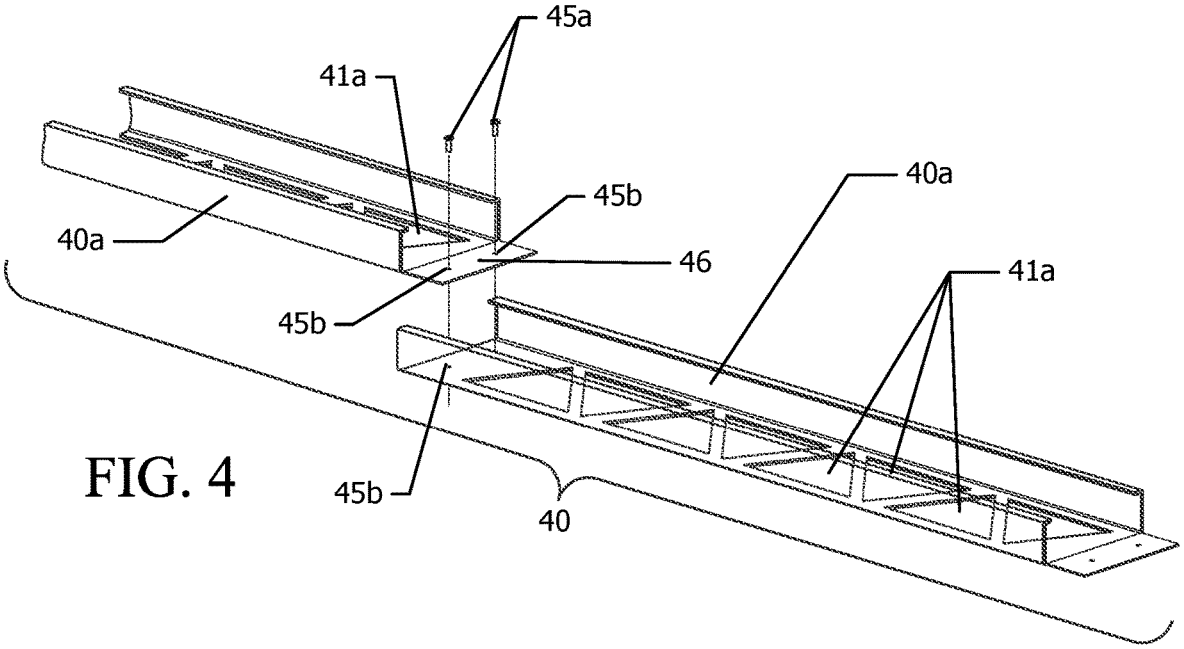
FIGS. 4 to 8 are illustrations of example internal brace supports and interconnections between internal brace supports.

FIGS. 4-8 illustrate different examples of internal brace support units for use in the internal brace support 40. A first example unit 40*a* is shown in FIG. 4. This example is a steel C-channel with openings 41*a* to provide one or more passages for pouring concrete, and positioning rebar or other reinforcement between the foam panels. Multiple units 40*a* interconnect by means of a tongue 46 extending from one end of the unit 40*a* that is received within the C-channel end of another unit 40A, and joined using fasteners 45*a* passing through corresponding bores or holes 45*b*.

Figure 5:
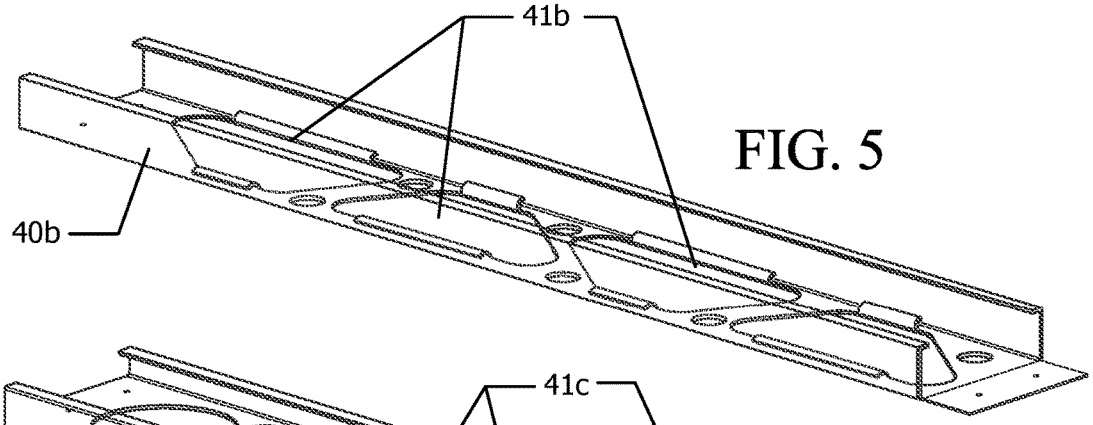

A second example unit 40*b* for use in the internal brace support 40 is illustrated in FIG. 5. This example unit 40*b* includes punchouts 41*b* that may be used to receive rebar and concrete. A third example unit 40*c*, shown in FIG. 6, also includes punchouts 41*c*.

Figure 6:
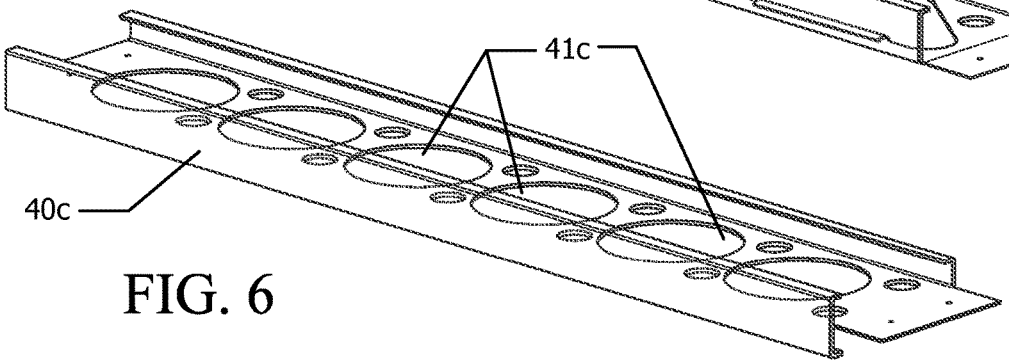
Figure 7:
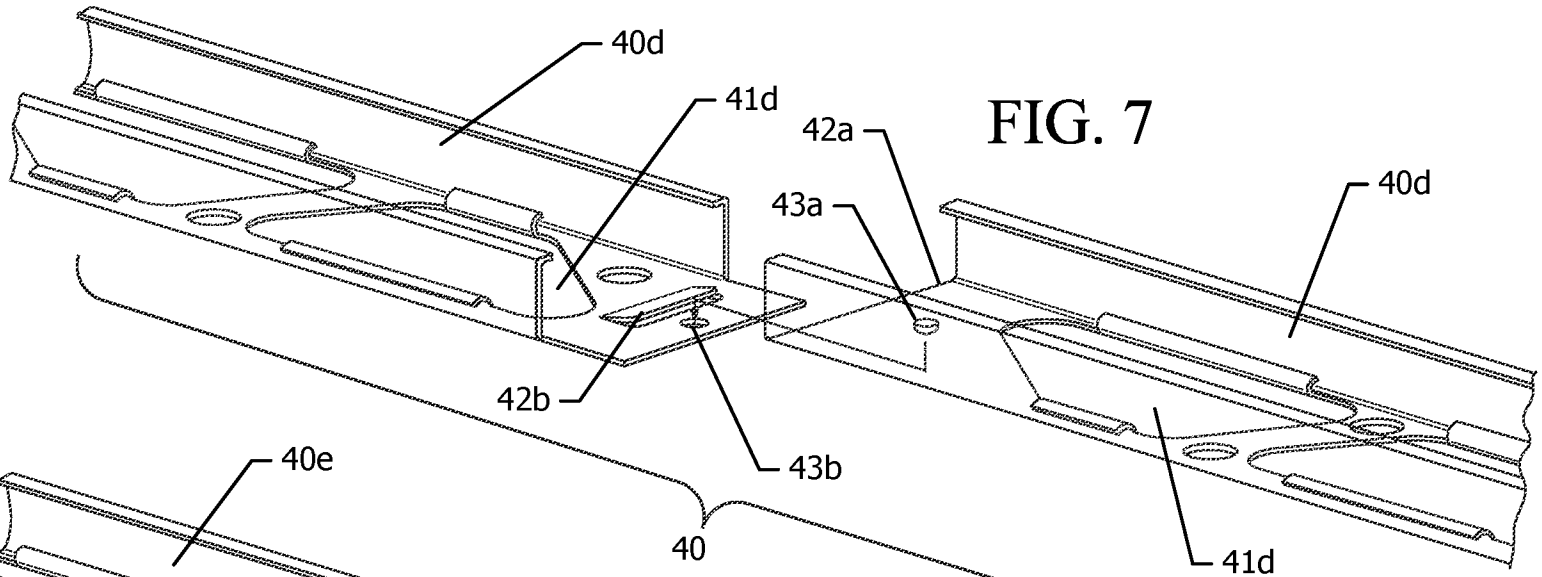
Figure 8:
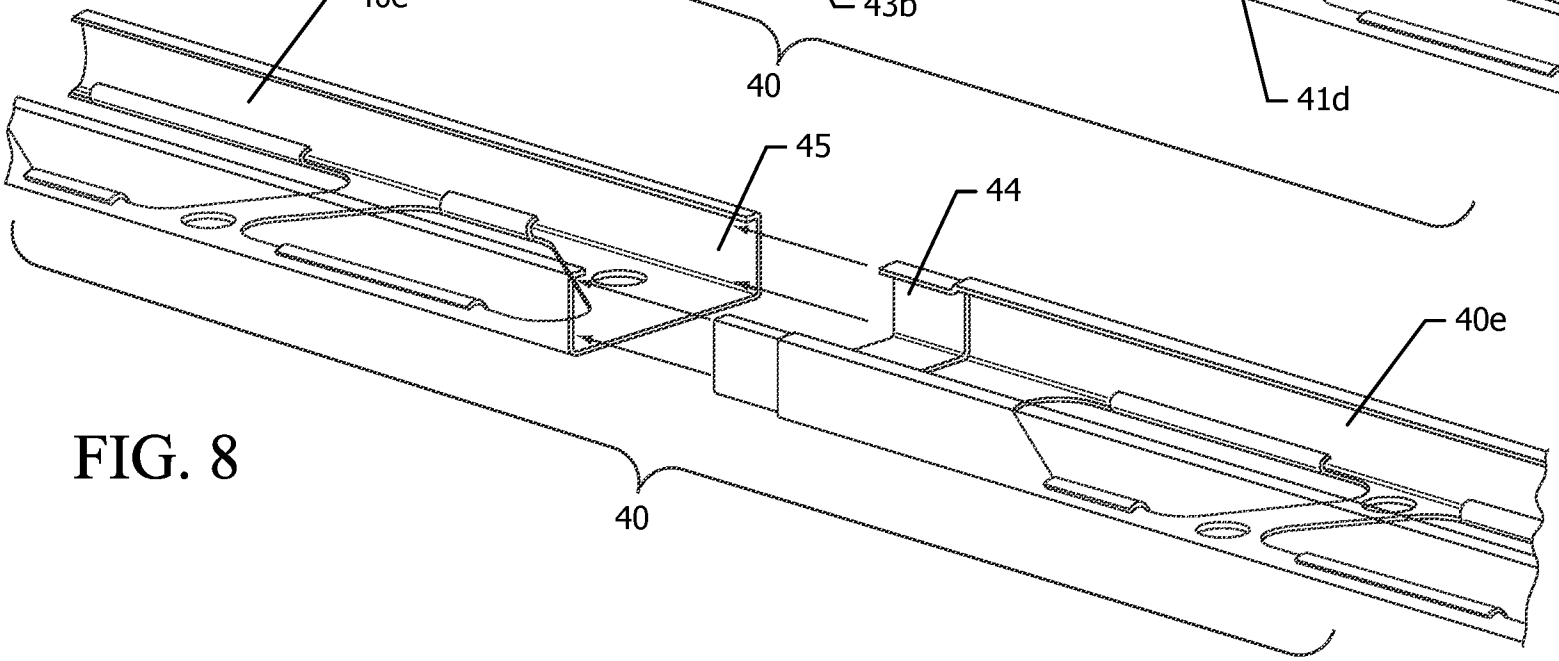

The example units of FIGS. 5 and 6 can be jointed to one another in a similar manner as that described for the first example unit 40*a* of FIG. 4. FIGS. 7 and 8 illustrate alternative connections that can be implemented for any of the above example units 40*a*, 40*b*, 40*c*. For example, as shown in FIG. 7, two adjacent units 40*d* can be aligned using a cooperating raised portion or depression 43*a* and hole or recess 43*b*, and/or a flap 42*b* punched out at the end of one unit 40*d* defining a slot or for receiving the opposing edge 42*a* of a second unit 40*d*. As shown in FIG. 8, the dimensions at one end 44*a* of a first unit 40*e* are reduced so that the end 44 can be slide-fitted into the opposing end 45 of another unit 40*e*. At corners of the system 10, internal brace supports 40 may be tied or otherwise fastened together. These examples are intended to be non-limiting, and other methods of engaging and adjacent internal brace support units in the internal brace support 40 may be used without departing from the inventive concepts described herein. Where the foundation wall or other structure forms a closed shape, the internal brace supports 40 can be fastened to likewise provide a closed (i.e., continuous or endless) shape, thus enhancing the rigidity of the internal brace supports 40.

Figure 9:
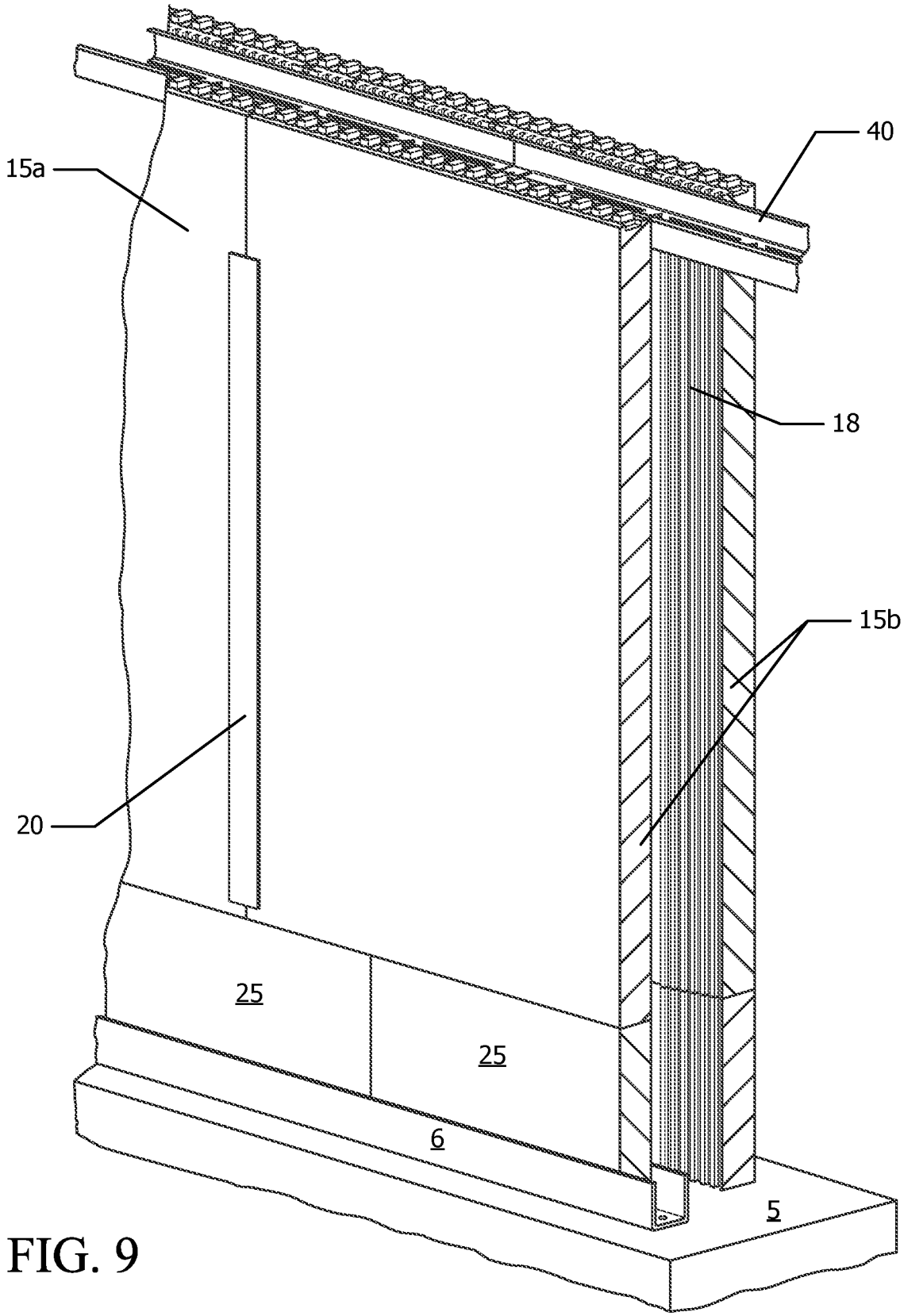
FIG. 9 is a perspective view of a section of the assembly of FIG. 1 with an inserted internal brace support, prior to a concrete pour.
Figure 10:
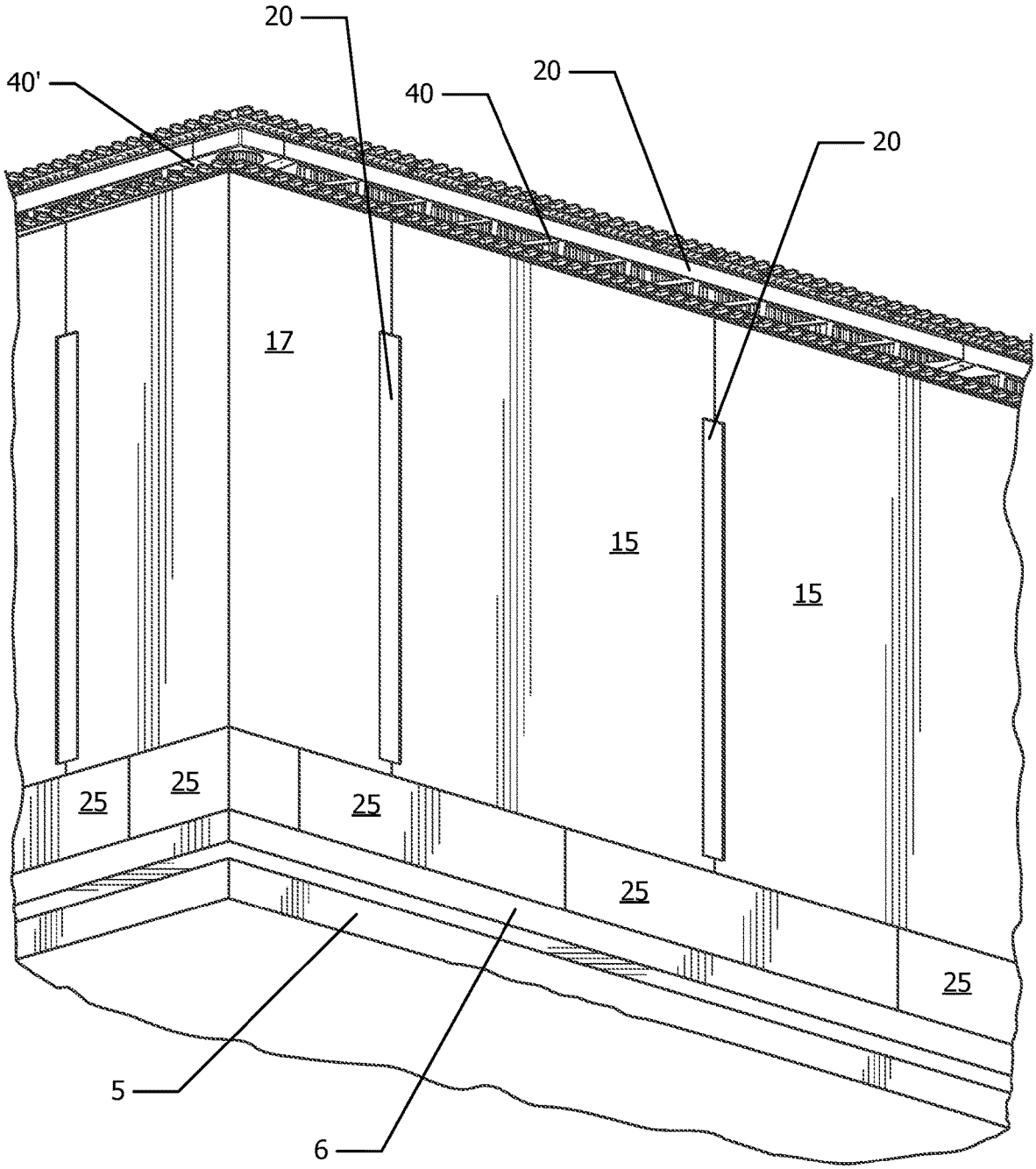
FIG. 10 is a perspective view of a corner section of the assembly of FIG. 1 with the inserted internal brace support, prior to the concrete pour.

FIG. 9 illustrates the same section as FIG. 3, after the internal brace support 40 has been installed in place between the pairs of foam panels. FIG. 10 provides a detail view of a corner of the system 10 illustrated in FIG. 1 without any optional superior horizontally-oriented ICF foam panels 30, 35, at which the internal brace wall supports 40, 40' for two wall sections intersect. These wall supports 40, 40' can be tied or otherwise fastened together to enhance rigidity of the overall structure for the concrete pour.

Figure 11:
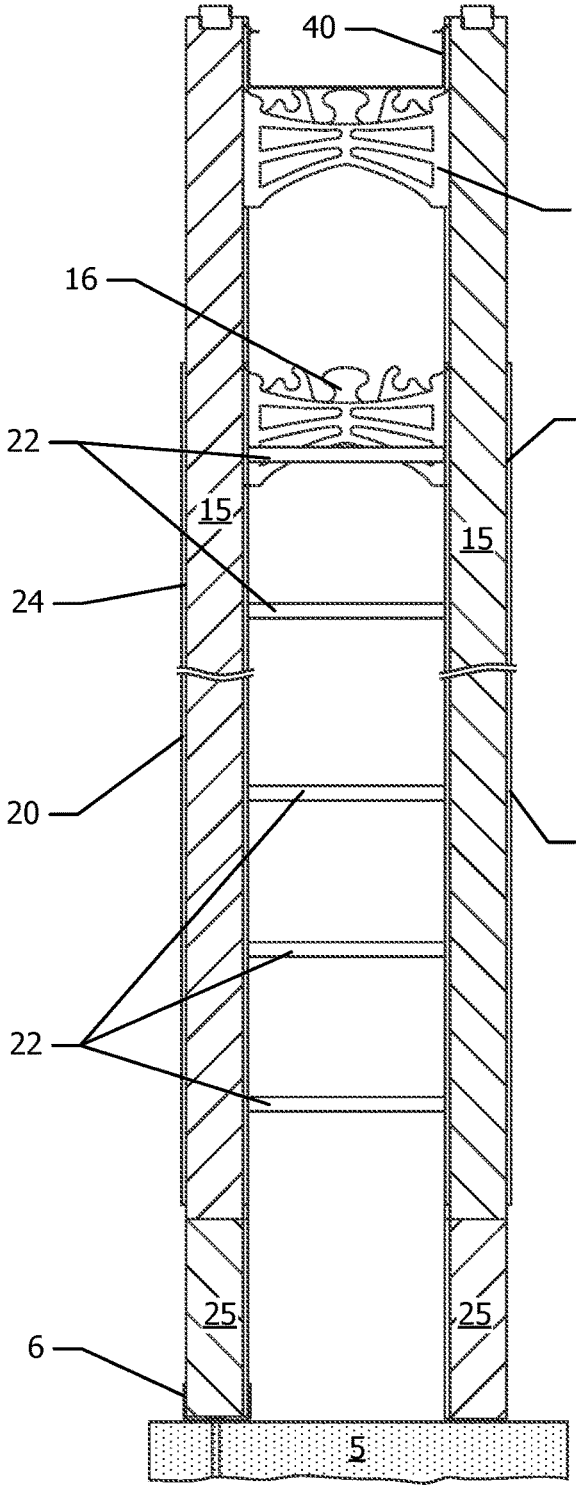
FIG. 11 is a cross-sectional view of the assembly of FIG. 9.

FIG. 11 illustrates a cross-sectional view of pairs of base and vertically-oriented panels 25, 15 as shown in FIG. 9 or 10 prior to a concrete pour, joined by a vertical panel support 20, one or more form ties 16, with the internal brace support 40 in place. The form ties 16 are not technically part of the sectional view, but are included to be informative of the complete structure. FIG. 10 provides a detail view of the top portion of FIG. 11, showing the upper ends of the vertically-oriented ICF foam panels 15 and uppermost form tie 16. It can be seen in this example that the internal brace wall support can rest on an upper surface of the form tie 16.

Once the pairs of vertically-oriented ICF foam panels 15 are erected with the vertical panel supports 20 in place, the internal brace support 40 is installed, and any optional superior panels 30, 35 and/or rebar or other reinforcements added, the ICF foundation wall system 10 can be completed by pouring concrete between erected vertically-oriented ICF foam panels 15, 17, 25, 27, 30, 35. The internal brace support 40 will be substantially or completely submerged once the concrete pour is complete. Note, however, that superior ICF foam panels 30, 35 can be positioned above the vertically-oriented ICF foam panels 15 after the concrete pour rather than before, depending upon the requirements of the structure and the availability of the concrete pouring crew; generally, however, the panels 30, 35 will be in place prior to the concrete pour so that only one pour is necessary. If the superior ICF foam panels 30, 35 are erected after the concrete pour, then a second concrete pour will be required to fill the superior panels 30, 35. A further example of superior ICF foam panel usage will be described with reference to FIG. 18.

Figure 12:
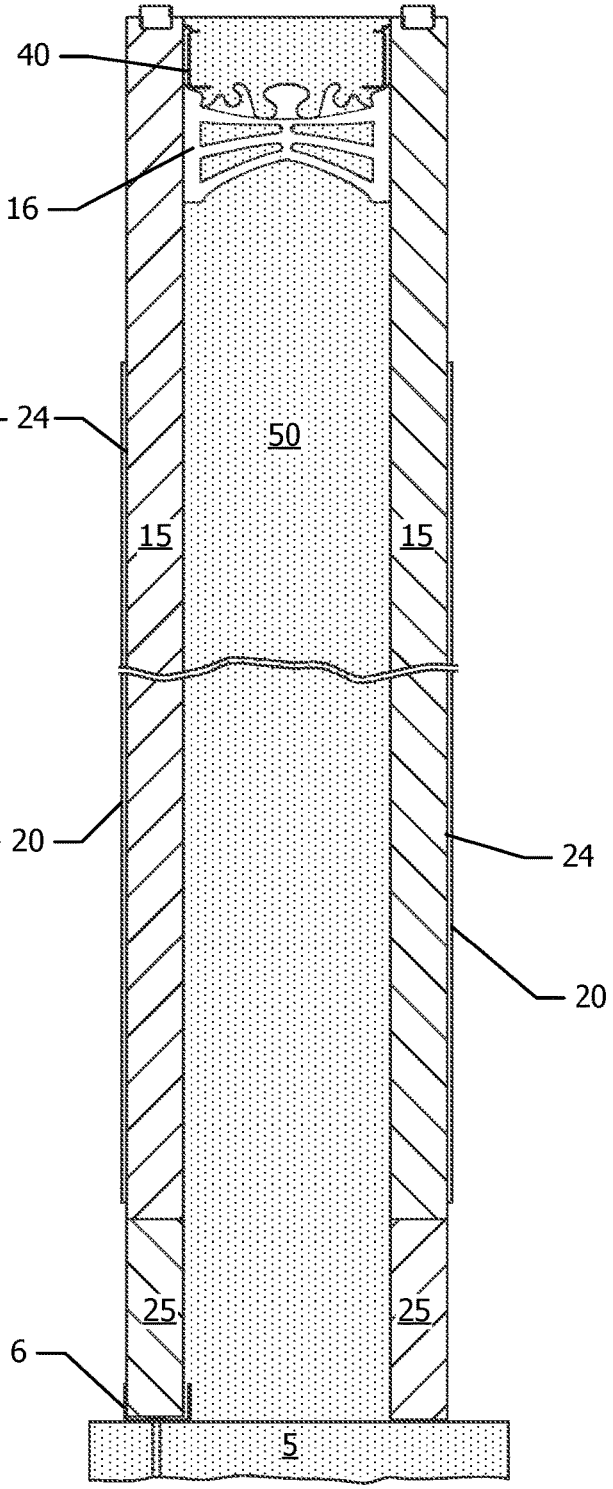
FIG. 12 is a cross-sectional view of the assembly of FIG. 9, after a concrete pour.
Figure 13:
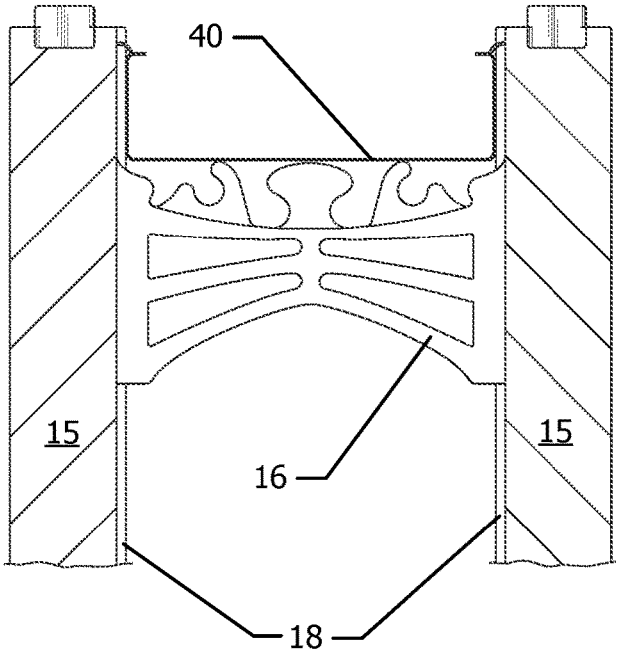
FIG. 13 is a detail view of FIG. 11.
Figure 14:
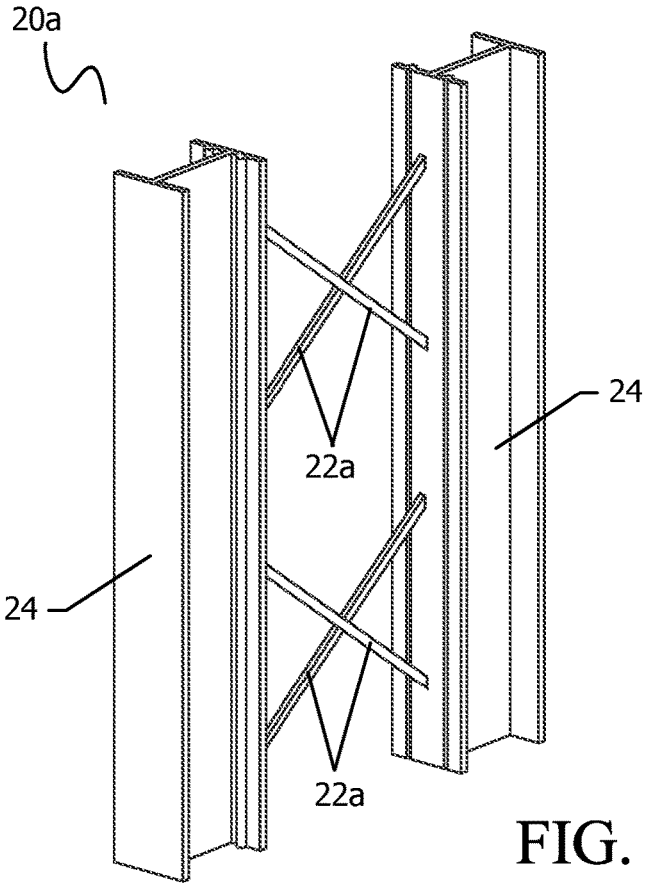
FIG. 14 is a perspective view of an example vertical panel support for use in ICF construction.
Figure 15:
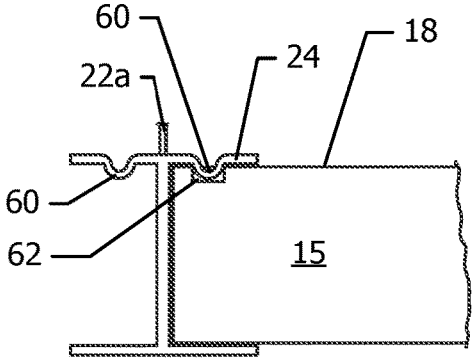
FIG. 15 is a plan view of the example vertical panel support of FIG. 14 retaining an ICF panel.

FIG. 12 shows the cross-sectional view of FIG. 11 after a concrete pour, with only one representative form tie 16 illustrated. After the concrete pour, the void between the pairs of ICF foam panels 15, 25 has been filled with a concrete core 50. The resulting ICF foundation wall system 10 thus includes a concrete core 50, embedded vertical panel support 20, and embedded internal brace support 40, supported by form ties 16. Optional rebar and other conventional or optional components of the concrete core 50 are omitted for clarity. However, it will be appreciated that reinforcements such as rebar can be positioned below the internal brace support 40 while still being supported by the form ties 16. This can be seen more clearly in FIG. 13, which illustrates the relative positions of the form tie 16 and internal brace support 40 between a pair of ICF panels 15. In FIG. 13, the internal brace support 40 has a C-channel shape; the sidewalls of the C-channel contact the interior faces of the ICF panels 15 to provide support to the panels.

Examples of the vertical panel support 20 are illustrated in FIGS. 14-17. The vertical panel support 20 retains adjacent foam panels 15 in substantially fixed lateral positions, and assists in resisting lateral motion of the panels when pressure is exerted against the panels during a concrete pour. The vertical panel support 20 may also assist in transferring any tensile stress between adjacent foam panels. In a first example vertical panel support 20*a*, shown in FIGS. 14 and 15, the clip members 24 are coupled by crossed tie members 22*a*. An interior, ICF panel-engaging face of each clip member 24 is provided with an engagement means to secure an ICF panel. As can be seen in the plan view of FIG. 15, the clip member 24 includes a stamped groove that creates a projection 60 into a channel defined by the clip member 24 for receiving a vertically-oriented ICF foam panel 15. The interior face 18 of the panel 15 can be provided with a textured surface, such as a series of one or more ribs and/or one or more grooves, such as groove 62. When the panel 15 is received by the clip member 24, the projection is received into a cooperating groove 62 to retain the panel 15 in a relatively fixed lateral position with respect to the vertical panel support 20*a*.

Figure 16:
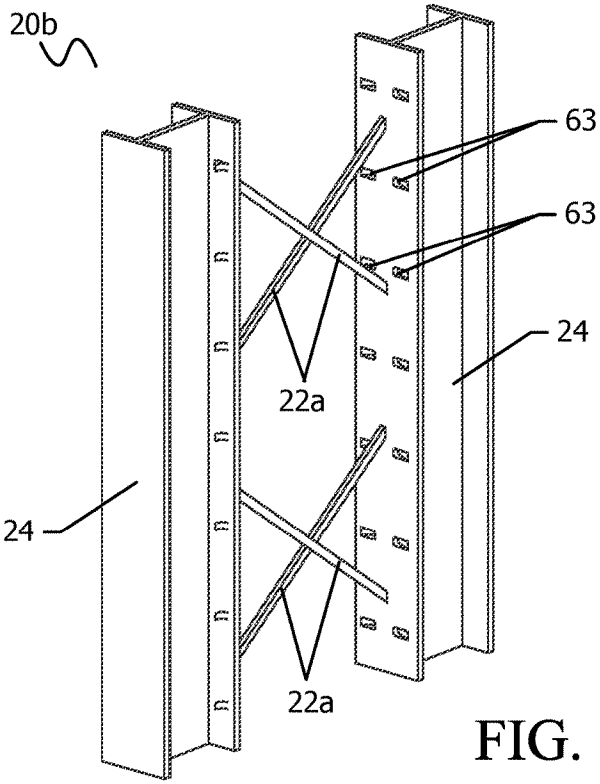
FIG. 16 is a perspective view of a further example vertical panel support for use in ICF construction.
Figure 17:
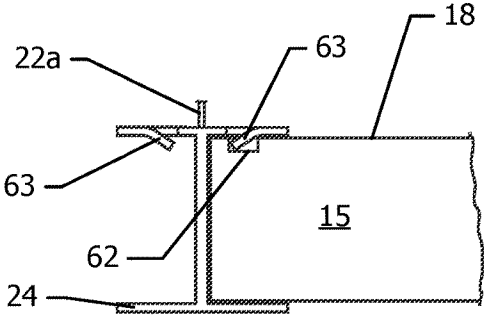
FIG. 17 is a plan view of the example vertical panel support of FIG. 16 retaining an ICF panel.

A second example of a vertical panel support 20*b* is shown in FIG. 16. This example has a similar structure to the vertical panel support 20*b* of FIG. 14, but rather than a projection 60, a series of teeth or partial punchouts 63 are provided on the interior panel-engaging faces of the clip member 24. As can be seen in the plan view of FIG. 17, when the foam panel 15 is received in the clip member 24, the tooth or partial punchout 63 engages the groove 62 on the interior surface 18 of the foam panel 15 to retain the foam panel in substantially fixed lateral relation to the vertical panel support 20*b*. Alternatively, the tooth or partial punchout 63 can simply bite into the interior surface 18 to retain the foam panel 15 in place.

As mentioned above, in some foundation wall designs the height of the foundation wall will need to vary in order to take into account design features such as doors and windows, or to accommodate changes in elevation in the ground surrounding the foundation. Because ICF foam panels are generally provided with standard heights, an ICF foundation wall at one location of a building may be substantially concealed by the ground at a first elevation, but several inches or feet of the foundation wall may be exposed in areas where the ground elevation drops away. It may be preferable to provide a partial brick or other finished façade that is substantially flush with the foundation wall, while still benefiting from the advantages of an ICF construction.

Figure 18:
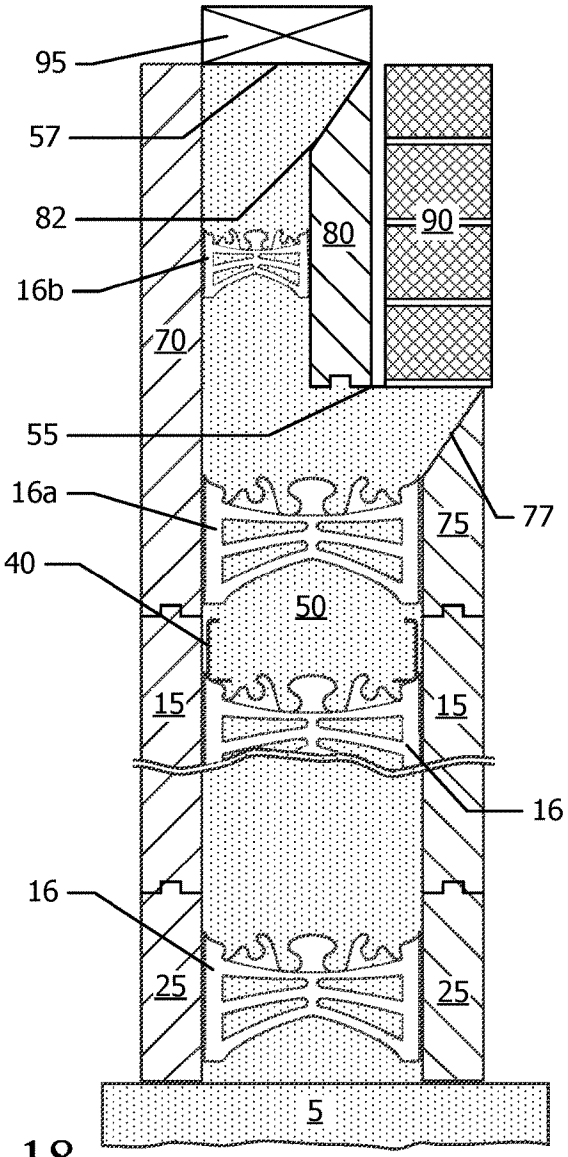
FIG. 18 is a cross-sectional view of a further assembly for use in ICF construction including a brick sill.

FIG. 18 illustrates a variation including modified superior panels 70, 75, 80 that can be used in addition to, or in place of, the vertically-oriented ICF foam panels 15 and/or 25. The view in FIG. 18 is a cross-sectional view similar to that of FIG. 12, illustrating the ICF construction of a foundation wall after a concrete pour, but in this case including a setback of the foundation wall and a brick sill 90. A lower portion of the foundation wall comprising the base and vertically-oriented pairs of foam panels 25, 15, reinforced with vertical panel supports 20 (not shown), interior brace supports 40, supported by form ties 16 as described above, can be erected in a manner similar to that described above. Next, one or more sets of superior ICF foam panels 70, 75, 80 is positioned above the uppermost foam panels 15. On one face of the foundation wall, a shorter panel 75 is provided with an inclined interior face 77 extending to an upper end of the panel 75. The interior of the panel 75 thus tapers, providing a widening space that may receive poured concrete. On the other face of the foundation wall, a second panel 70 has a greater height than the tapered panel 75. A third panel 80, which will define the exterior face of the foundation behind the façade, is spaced apart from both the first and second panels 75, 70 to define a narrower wall. The third panel 80 also includes an inclined interior face 82, which again creates a wider space for receiving poured concrete. The inclined interior face, however, may be provided on the second panel 70 instead.

Like the pairs of panels 15, 25, and 35, these sets of superior foam panels 70, 75, 80 can be provided as a single unit, connected by form ties 16*a*, 16*b* sized to hold the panels 75 and 80 the desired distance away from the panel 70, as illustrated in the example of FIG. 18. Thus, for example, the set of superior foam panels can be a set of interconnected ICF panels, with the first ICF panel 70 joined to and spaced apart from the second ICF panel 75 by one or more form ties 16, and the first ICF panel 70 joined to and spaced apart from the third ICF panel 80. Thus, the first and second panels 70, 75 define a first region into which concrete is poured, while the first and third panels 70, 80 define a second region for the poured concrete; these two regions are contiguous, so concrete poured into interconnected ICF panels fills both regions. The first region, which defines a base or sill for the brick façade or other structure, is wider than the second region, which creates a setback that accommodates the width of the bricks.

Once the superior sets of panels 70, 75, 80 are in place, and additional interior brace supports 40 are positioned within the superior set (not shown in FIG. 18), the concrete can be poured to the level of the upper end of the panel 75. The ICF foundation wall thus defines a setback in which the façade 90, such as the illustrated brick sill, can be constructed on the concrete surface 55. FIG. 18 illustrates a lower portion of wood framing that may be constructed on the upper surface 57 finished ICF foundation wall.

The heights of ICF foam panels 70, 75, and 80 may be selected according to the requirements for the particular foundation design and/or elevation. For example, the sill-supporting superior panel 75 can be provided in varying heights, such as 7", 14", and/or 21", as may the third panel 80. This range of heights can provide for a graduated change in height to match a gradual change in elevation in the ground surrounding a foundation. The varying heights may be selected in order to correspond with the conventional heights of bricks or other building materials; for instance, a height of 7" is approximately equivalent to a two-brick deep wall.

It will also be understood that while the three panels 70, 75, and 80 in this example are used to create a setback in the foundation wall structure, any combination of superior ICF panels of varying dimensions 70, 75, 80, 30, and/or 35 may be used to produce a foundation wall with varying heights or openings to support not only doors or brick sills 90, but also step walls and other features.

The foregoing examples were described in the context of an ICF assembly comprising both horizontally-oriented and vertically-oriented foam ICF panels 25, 15, with the vertically-oriented foam ICF panels 15 defining a significant portion of the foundation wall or other ICF assembly, as can be seen in FIG. 1. Construction may proceed faster when vertically-oriented ICF panels are used, since the desired structure height can be attained more quickly as compared to using only horizontally-oriented ICF panels. ICF assemblies using vertically-oriented panels benefit from the use of the vertical panel supports 20 to retain the panels 15 in position.

Figure 19:
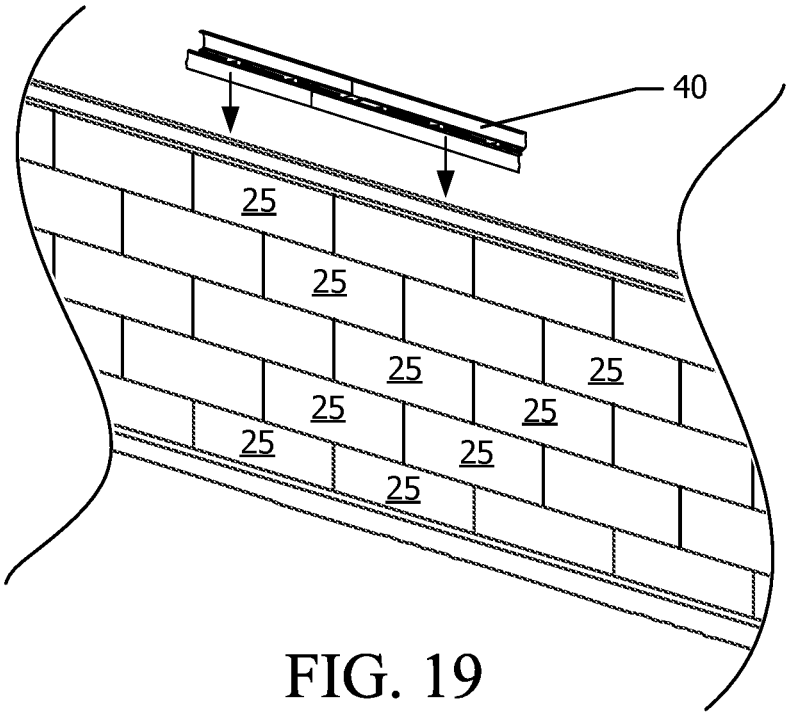
FIGS. 19 and 20 are perspective views of further example ICF assembly walls.
Figure 20:
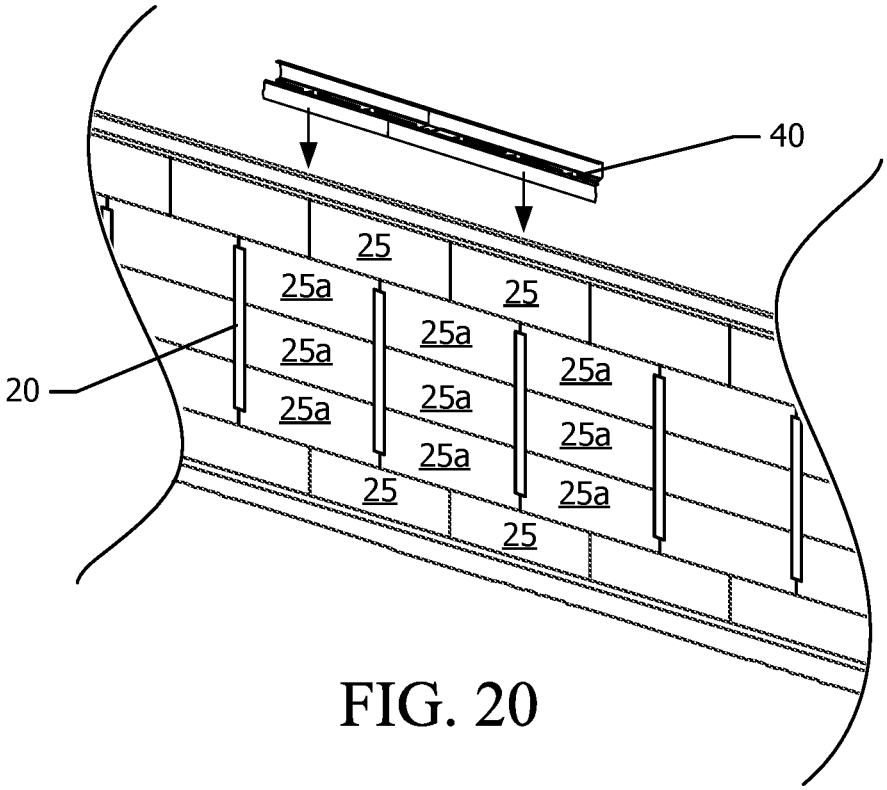

However, the internal support concepts discussed above may also be used with ICF assemblies constructed without the use of vertically-oriented panels 15. FIGS. 19 and 20 illustrate two other example ICF wall constructions. In FIG. 19, multiple rows of pairs of horizontally-oriented ICF panels 25 are stacked in staggered relation to the desired height (additional superior rows of panels 35 or 70, 75, 80 may also be used, as described above). As will be understood by those skilled in the art, the pairs of horizontally-oriented ICF panels 25 are connected with form ties 16, not shown in FIG. 19; and furthermore, the vertical panel supports 20 may not be needed since the seams between adjacent panels 25 are staggered with respect to the previous row. As shown in FIG. 19, the internal brace support 40 can be inserted between the pairs of panels 25, supported by the form ties connecting the panels 25, to extend laterally along the structure. Similarly, FIG. 20 illustrates a construction in which columns of aligned horizontally-oriented panels 25*a* are mounted in staggered fashion between lower and superior rows of panels 25. Vertical panel supports 20 may be used between the columns of panels 25*a*, and again, the internal brace support 40 can be inserted between the uppermost pairs of panels 25 (or 25*a*) in the structure.

The subject invention having been thus described in detail, it will be apparent to those skilled in the art that variations and modifications may be made without departing from the invention. The invention includes all such variations and modifications as fall within the scope of the appended claims.

The invention claimed is:

1. An insulated concrete form (ICF) structure, comprising:

a plurality of pairs of ICF panels adjacent to one another and defining between their interior surfaces an interior region for receiving poured concrete between individual ICF panels of the plurality of pairs of ICF panels, wherein each pair of ICF panels of the plurality of pairs of ICF panels are coupled to each other by form ties extending between their interior surfaces;

a plurality of internal brace supports entirely disposed in the interior region, the plurality of internal brace supports being positioned below an upper end of the plurality of pairs of ICF panels and completely within the interior region for receiving poured concrete, at least some of the plurality of internal brace supports resting on one or more form ties, each internal brace support comprising an elongated body and sides projecting therefrom, a projecting side of at least some of the internal brace supports contacting a corresponding interior surface of an ICF panel; and concrete poured in the interior region such that the plurality of internal brace supports are completely submerged in the poured concrete.

2. The ICF structure of claim 1, wherein each internal brace support is connected to at least one adjacent internal brace support.

3. The ICF structure of claim 1, wherein the elongated body of each internal brace support comprises apertures or recesses permitting passage of poured concrete therethrough.

4. The ICF structure of claim 1, wherein each internal brace support comprises a pair of projecting sides, and both of the projecting sides of at least some of the internal brace supports contact a corresponding interior surface of an ICF panel of the plurality of pairs of ICF panels.

5. The ICF structure of claim 1, wherein the ICF structure comprises a closed shape defined by the plurality of pairs of ICF panels.

6. The ICF structure of claim 5, wherein the plurality of internal brace supports are connected in a closed shape.

7. The ICF structure of claim 1, further comprising a plurality of vertical panel supports engaging adjacent ones of the plurality of pairs of ICF panels.

8. The ICF structure of claim 1, wherein the plurality of pairs of ICF panels are disposed on a footing.

9. The ICF structure of claim 1, further comprising a set of superior ICF panels mounted on the plurality of pairs of ICF panels, the interior region for receiving poured concrete being further defined by the set of superior ICF panels, wherein the set of superior ICF panels comprises an ICF panel assembly comprising:

a first ICF panel joined to and spaced apart from a second ICF panel by at least one form tie, the first ICF panel and second ICF panel thus defining between them a first region for receiving concrete, the first region having a first width; and a third ICF panel joined to and spaced apart from the first ICF panel by at least one form tie, the first ICF panel and the third ICF panel thus defining between them a second region for receiving concrete contiguous with the first region, the second region having a second width narrower than the first width, the concrete defining a sill at an upper edge of the second ICF panel.

10. The ICF structure of claim 1, further comprising rebar disposed in the interior region and completely submerged in the concrete.

11. The ICF structure of claim 1, wherein the ICF structure comprises a building foundation.

12. The ICF structure of claim 1, wherein the plurality of internal brace supports extend along an entirety of the interior region.

13. The ICF structure of claim 12, wherein the plurality of internal brace supports rest on at least one form tie in each pair of ICF panels of the plurality of pairs of ICF panels.

14. The ICF structure of claim 4, wherein both of the projecting sides of each internal brace support contact a corresponding interior surface of an ICF panel of the plurality of pairs of ICF panels.

15. The ICF structure of claim 4, wherein the plurality of internal brace supports are connected.

16. The ICF structure of claim 15, wherein the plurality of internal brace supports are connected in a closed shape.

17. The ICF structure of claim 15, further comprising a plurality of vertical panel supports engaging adjacent ones of the plurality of pairs of ICF panels.

* * * * *